United States Patent [19]

Hashimoto et al.

[11] Patent Number: 4,458,119

[45] Date of Patent: Jul. 3, 1984

[54] HYBRID CIRCUIT BREAKER

[75] Inventors: Tadashi Hashimoto, Higashimine; Ken Morita, Kawasaki, both of Japan

[73] Assignee: Tokyo Shibaura Denki Kabushiki Kaisha, Kawasaki, Japan

[21] Appl. No.: 430,378

[22] Filed: Sep. 30, 1982

[30] Foreign Application Priority Data

May 27, 1982 [JP] Japan ..... 57-88797

[51] Int. Cl.[3] ..... H01H 33/04

[52] U.S. Cl. ..... 200/145; 200/144 B; 200/148 A

[58] Field of Search ..... 200/144 B, 148 R, 145, 200/148 A; 361/3, 5, 14, 2, 6, 7

[56] References Cited

U.S. PATENT DOCUMENTS 3,303,309 2/1967 Flurscheim et al. ..... 200/144 B 4,159,498 6/1979 Noeske ..... 200/148 R 4,315,119 2/1982 Kishi et al. ..... 200/148 A

*Primary Examiner*—E. A. Goldberg

*Assistant Examiner*—Morris Ginsburg

*Attorney, Agent, or Firm*—Oblon, Fisher, Spivak, McClelland & Maier

[57] ABSTRACT

There is disclosed a vacuum circuit breaker unit wherein a fixed contact and a movable contact which can be brought into contact with or separated from each other are accommodated in a vacuum valve, as well as a gas circuit breaker unit, in which a fixed contact and movable contact are provided in a sealed container containing insulating gas. The vacuum circuit breaker unit and the gas circuit breaker unit are connected in series and accommodated in an earthed tank with a vacuum valve being surrounded by a decomposition gas-proof sealed container.

4 Claims, 1 Drawing Figure

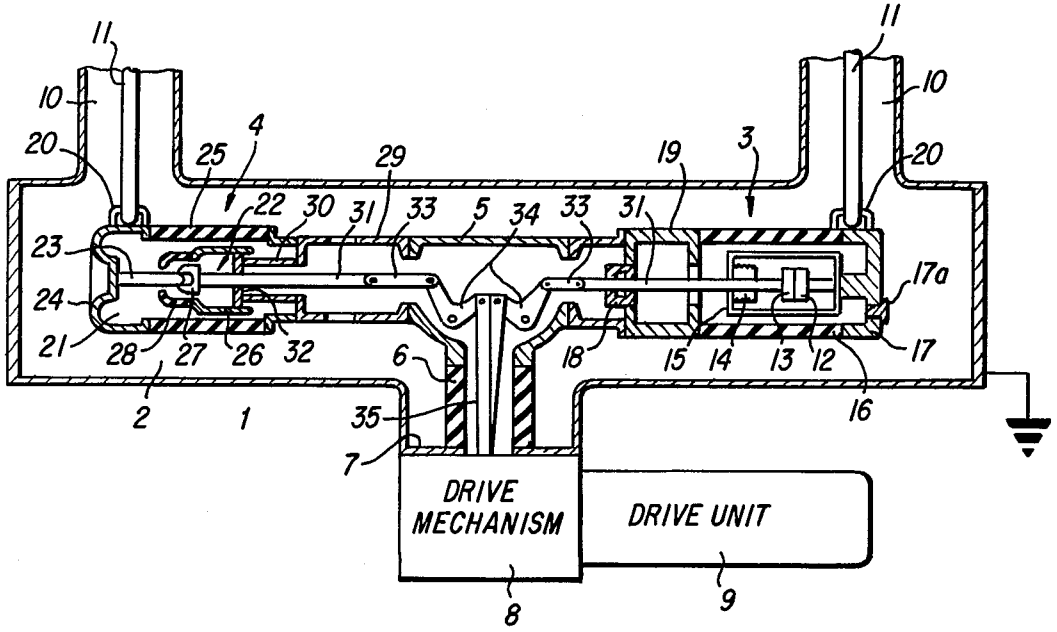
DRIVE UNIT
DRIVE MECHANISM

HYBRID CIRCUIT BREAKER

BACKGROUND OF THE INVENTION

1. Field of the Invention

This invention relates to the construction of circuit breakers which can be used for DC circuit breaking, and in particular to hybrid circuit breakers consisting of a vacuum circuit breaker portion and a gas circuit breaker portion connected in series.

2. Description of the Prior Art

Usually DC circuit breakers comprise a condenser/-reactor circuit in parallel with a circuit breaking portion, and circuit breaking is performed by discharging the charge stored in the condenser through a reactance. The oscillating current which is then produced is superimposed on the DC current of the main circuit to artificially create a current zero point. The contacts of the circuit breaking portion are opened in synchronization with this current zero point, to achieve circuit breaking. However, if a vacuum circuit breaker is used as the circuit breaking portion, sufficient safety cannot be at present achieved by the use of such a vacuum circuit breaker alone, since the characteristics of vacuum circuit breakers make them liable to restriking of the arc. So-called hybrid circuit breakers, as described in U.S. Pat. No. 4,159,498, have therefore been devised, in which circuit breaking is achieved by a series combination of a vacuum circuit breaker and gas circuit breaker, the former performing the initial circuit breaking while the latter is allotted the task of recovery of insulation after circuit breaking.

The excellence of such hybrid circuit breakers for DC circuit breaking has been proved. Such hybrid circuit breakers comprise a gas circuit breaker portion and vacuum circuit breaker portion connected in series in a closed tank, which is filled with insulating gas (for example SF6 gas). However, when a vacuum circuit breaker portion and gas circuit breaker portion are accommodated together in the same tank, there is the following drawback. Specifically, in the case of an SF6 gas circuit breaker, when the current is broken, decomposition gas is produced. Most of this recombines to form SF6 again, but some remains as decomposition gas, and may cause corrosion of the material of the circuit breaker. For this reason the circuit breaking portion of an SF6 gas circuit breaker is made of decomposition gas-proof material. However, the vacuum valve container which constitutes the vacuum circuit breaking portion is made of borosilicate glass, which is liable to corrosion by decomposition gas. When a gas circuit breaking portion and vacuum circuit breaking portion are accommodated together in the same tank, some means of preventing corrosion must therefore be adopted.

SUMMARY OF THE INVENTION

Accordingly, one object of the present invention is to provide a hybrid circuit breaker, formed by the series connection of a gas circuit breaking portion and a vacuum circuit breaking portion, wherein the vacuum valve can be protected from the decomposition gas that is produced when the gas circuit breaking portion breaks the current.

This object is attained in the present invention by a vacuum circuit breaker unit wherein a fixed contact and a movable contact which can be brought into contact with or separated from each other are accommodated in a vacuum valve, and a gas circuit breaker unit wherein a fixed contact and a movable contact are provided in a sealed container containing insulating gas with both the vacuum circuit breaker and the gas breaker being connected in series and accommodated in an earthed tank with the vacuum valve being surrounded by a decomposition gas-proof sealed container.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein: The FIGURE is a sectional view showing a hybrid DC circuit breaker constituting an embodiment of this invention.

DETAILED DESCRIPTION OF THE PREFERRED EMBODIMENT

An embodiment of this invention is explained below with reference to the drawing. In the drawing, an insulating gas 2 such as SF6 gas is sealed into the earthed tank 1 at a gauge pressure of 3–5 $Kg/cm^2$. A vacuum circuit breaking unit 3 and gas circuit breaking unit 4 are supported in an insulating manner in a bottom portion 7 of the earthed tank 1 by means of an insulating tube 6. On the outside of the earthed or grounded tank 1 there are provided a drive mechanism 8 that switches the vacuum circuit breaking unit 3 and gas circuit breaking unit 4, and a drive unit 9 driven by air or oil pressure etc. Conductors 11 are inserted into openings 10 arranged at both of the two top longitudinal ends of the earthed tank 1. One end of these respective conductors 11 abuts one end of the vacuum circuit breaking unit 3 and gas circuit breaking unit 4, while their other end is connected to a bus or bushing, not shown.

The vacuum circuit breaking unit 3 is constructed of: a vacuum valve 15 that is maintained gas-tight by a bellows 14 and is provided in its interior with a movable contact 13 that is arranged opposite to a fixed contact 12 which it can be brought into contact with or separated from; a cylindrical insulating tube 16 made of decomposition gas-proof material that surrounds the said vacuum valve 15; a conductive support member 17, which is fixed at one end of the said insulating tube 16 and which supports the fixed contact 12 of the vacuum valve 15; and a conductive support member 19 that is fixed to the other end of the insulating tube 16 and which supports the movable contact 13 of the vacuum valve 15 in a freely slidable gas-tight manner at its middle region 18, within the insulating tube 16. A finger 20 which electrically connects the conductor 11 and support member 17 is mounted at the top of the support member 17. The support member 17 in conjunction with insulating tube 16 and the support member 19 also forms a closed space, different from the space in the earthed tank 1 which is provided with an opening in a part thereof, this opening being closed by a plug 17*a*. The vacuum circuit breaking unit 3 and gas circuit breaking unit 4 are connected in series by means of center-piece 5 and fixed support member 29.

The gas circuit breaking unit 4 includes a fixed contact portion 21 and movable contact portion 22. The fixed contact portion 21 is composed of a fixed electrode 23 and a fixed member 24 that is electrically and mechanically connected to the fixed electrode 23. The fixed electrode portion 21 is fixed, through an insulating tube 25, to a piston 30 that constitutes the movable contact portion 22. A finger 20 that electrically connects the conductor 11 to the fixed member 24 is implanted in the top of the fixed member 24.

The movable contact portion 22 includes: a cylinder 26; an arc electrode 27 that engages the fixed electrode 23; an insulating nozzle 28 that encloses the arc electrode 27 and is fixed to the cylinder 26; a piston 30 that is fixed to the fixed support member 29 and which is capable of sliding through the interior of the said cylinder 26; and a rod 31 which is made to slide by the piston 30 through the cylinder 26, to open and close the fixed electrode 23 in cylinder 26. The rod 31 is slidable supported by a bearing 32 provided in the piston 30. The rods 31, which are connected to the movable contact 13 of the vacuum circuit breaking unit 3 and to the movable contact portion 22 of the gas circuit breaking unit 4, are connected, through respective levers 33, to one end of crank levers 34 that are rotatably pivoted on the center-piece 5. The other ends of the crank levers 34 are connected to an insulating rod 35. The other end of the insulating rod 35 is connected to a drive means, not shown, in the drive mechanism 8.

The current-breaking action of the above construction will now be explained. The drawing shows the circuit breaker in the current-carrying condition.

The insulating rod 35 is moved downwards by means such as oil pressure or air pressure, not shown, in the drive mechanism 8. This rotates the crank lever 34 of the vacuum circuit breaking unit 3 in the anticlockwise direction and the crank lever 34 of the gas circuit breaking unit 4 in the clockwise direction. The movable contact 13 of the vacuum circuit breaking unit 3 is shifted to the left, and the rod 31 of the gas circuit breaking unit 4 is shifted to the right. The wipe of the gas circuit breaking unit 4 is set to be greater than the wipe of the vacuum circuit breaking unit 3. That is, when the contacts are open, the distance between the fixed contact 12 and movable contact 13 of the vacuum circuit breaking unit 3 is shorter than the distance, when the contacts are open, between the fixed contact 23 and movable contact 22 of the gas circuit breaking unit 4. The vacuum circuit breaking unit 3 therefore opens in advance of the gas circuit breaking unit 4. The current is therefore broken by this earlier-opening vacuum circuit breaking unit 3. The contacts of the gas circuit breaking unit 4 open after the current has been broken by the vacuum circuit breaking unit 3. Thus the gas circuit breaking unit 4 is allotted the task of recovery of insulation immediately after the current has been broken by the vacuum circuit breaking unit 3. The construction of the vacuum circuit breaking unit 3 and gas circuit breaking unit 4 is not restricted to being as explained above. In particular, since it is not essential for the gas circuit breaking unit 4 to break the current, it could be an isolator, such as is normally used, without current-breaking ability. In this invention, the concept of a circuit breaking unit therefore includes a gas isolator.

This invention is not limited to the embodiment described above, and other embodiments could easily be devised by those skilled in the art, in which corrosion of the borosilicate glass of the vacuum valve is prevented by preventing dispersion within the tank of the decomposition gas that is produced during circuit-breaking by the gas circuit breaking unit, by sealing the gas circuit breaking unit within an insulating container.

As explained above, since the vacuum valve is sealed in a closed container in the earthed tank, the borosilicate glass of the vacuum valve is not corroded by the composition gas produced during circuit breaking by the gas circuit breaking unit. If required, the circuit breaking capability of the gas circuit breaking unit can be improved by altering the gas pressure in the earthed tank and the closed container in which the vacuum valve is sealed.

As explained above, this invention makes possible the realization of a hybrid circuit breaker which is of simple construction, has excellent circuit breaking capability, and is reliable and economic.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hybrid circuit breaker device for breaking high voltage DC current comprising:

vacuum circuit breaking means for electrical connection to said high voltage DC current having;

an outer decomposition proof sealed gas container;

a vacuum container contained within said decomposition proof gas container, a fixed contact means contained within said vacuum container, a movable contact means contained within said vacuum container adapted so that said movable contact means and said fixed contact means can be brought into and separated from said fixed contact means, for interrupting said DC current;

gas circuit breaking means electrically connected in series with said vacuum circuit breaking means having a fixed contact means and a movable contact means adapted so that said movable contact means and said fixed contact means can be brought into and separated from said fixed contact means, for interrupting and isolating said DC current;

drive unit means that brings into and separates the respective movable and fixed contact means of said vacuum circuit breaking means and said gas circuit breaking means;

a sealed grounded tank containing insulating gas, said vacuum circuit breaking means and said gas circuit breaking means; and supporting means supporting said vacuum circuit breaking means and said gas circuit breaking means within said sealed grounded tank.

2. The circuit breaker device according to claim 1 wherein said drive unit means comprises a pair of rotatable crank levers connected to each of said movable contact means of said vacuum circuit breaking means and said gas circuit breaking means, respectively.

3. The circuit breaker device of claim 1 wherein said movable contact means of said gas circuit breaking means comprises:

a cylinder;

an arc electrode for contacting a fixed contact;

an insulating nozzle enclosing said arc contact which is fixed to said cylinder; and a piston slidable in said cylinder.

4. The circuit breaker device of claim 1 wherein said vacuum circuit breaker means further comprises:

a vacuum valve containing said movable contact means;

a gas-proof constructed cylindrical insulating tube surrounding said vacuum valve;

a first conductive support fixed to one end of said insulating tube for supporting said fixed contact means;

a second conductive support fixed to the other end of said insulating tube for supporting said movable contact means in a slidable manner within said insulating tube.

* * * * *